US007768541B2

(12) United States Patent
Koroishi et al.

(10) Patent No.: US 7,768,541 B2
(45) Date of Patent: Aug. 3, 2010

(54) HEATING RESISTOR ELEMENT, MANUFACTURING METHOD FOR THE SAME, THERMAL HEAD, AND PRINTER

(75) Inventors: Keitaro Koroishi, Chiba (JP); Toshimitsu Morooka, Chiba (JP); Noriyoshi Shoji, Chiba (JP); Yoshinori Sato, Chiba (JP); Norimitsu Sanbongi, Chiba (JP)

(73) Assignee: Seiko Instruments Inc., Chiba (JP)

( * ) Notice: Subject to any disclaimer, the term of this patent is extended or adjusted under 35 U.S.C. 154(b) by 64 days.

(21) Appl. No.: 12/254,504

(22) Filed: Oct. 20, 2008

(65) Prior Publication Data

US 2009/0102911 A1 Apr. 23, 2009

(30) Foreign Application Priority Data

Oct. 23, 2007 (JP) ..... 2007-275593
Aug. 27, 2008 (JP) ..... 2008-218635

(51) Int. Cl.
*B41J 2/335* (2006.01)

(52) U.S. Cl. ..... 347/202; 347/205

(58) Field of Classification Search ..... 347/202, 347/205

See application file for complete search history.

(56) References Cited

U.S. PATENT DOCUMENTS 5,357,271 A * 10/1994 Wiklof et al. ..... 347/197
5,940,109 A * 8/1999 Taniguchi et al. ..... 347/205
5,949,465 A * 9/1999 Taniguchi et al. ..... 347/205
7,522,178 B2 * 4/2009 Shoji et al. ..... 347/205

FOREIGN PATENT DOCUMENTS

JP 2007-083532 A 4/2007

OTHER PUBLICATIONS

Machine translation of JP 2007-083532, published on Apr. 2007.*

* cited by examiner

*Primary Examiner*—Huan H Tran
(74) *Attorney, Agent, or Firm*—Brinks Hofer Gilson & Lione

(57) ABSTRACT

Provided is a heating resistor element including: an insulating substrate including a glass material; a heat accumulating layer bonded to the insulating substrate through heating to temperature ranging from an annealing point to a softening point in a state of being adhered to a surface of the insulating substrate, and including the same material as the glass material of the insulating substrate; and a heating resistor provided on the heat accumulating layer, in which, on at least one of bonded surfaces between the insulating substrate and the heat accumulating layer, at least one of the insulating substrate and the heat accumulating layer is provided with a concave portion in a region opposed to the heating resistor to form a hollow portion. Accordingly, deformation caused by a difference in coefficient of thermal expansion is suppressed to improve printing quality.

12 Claims, 9 Drawing Sheets

FIG. 4A
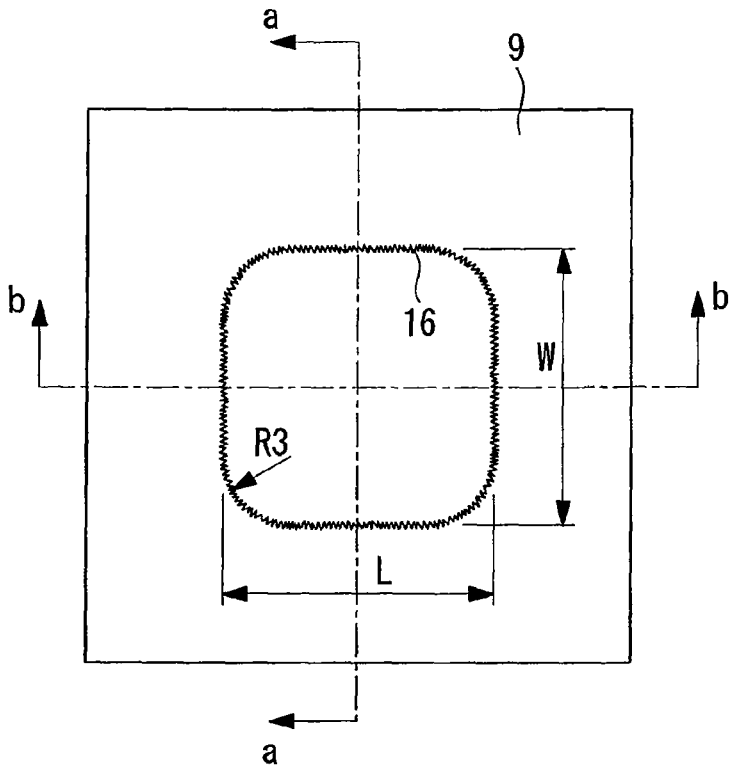
FIG. 4B
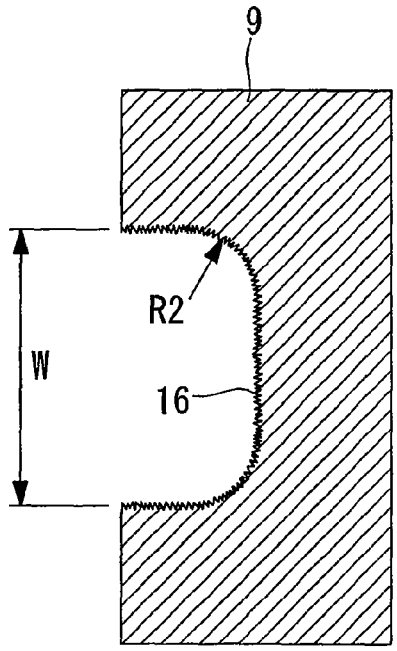
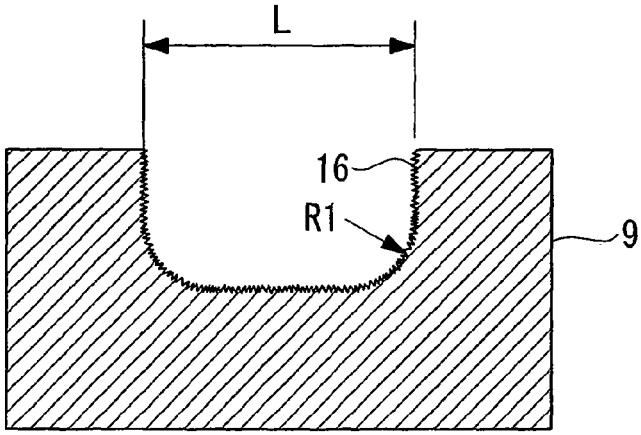
FIG. 4C

HEATING RESISTOR ELEMENT, MANUFACTURING METHOD FOR THE SAME, THERMAL HEAD, AND PRINTER

RELATED APPLICATIONS

This application claims priority under 35 U.S.C. §119 to Japanese Patent Application Nos. JP2007-275593 filed on Oct. 23, 2007 and JP2008-218635 filed on Aug. 27, 2008, the entire contents of which are hereby incorporated by reference.

BACKGROUND OF THE INVENTION

1. Field of the Invention

The present invention relates to a heating resistor element, a manufacturing method for the same, a thermal head, and a printer.

2. Description of the Related Art

Conventionally, in a heating resistor element provided in a thermal head of a printer, in order to improve heating efficiency of a heating resistor and to reduce power consumption, a hollow portion is formed in a region opposed to the heating resistor, and the hollow portion is caused to function as a heat insulating layer having low heat conductivity, thereby controlling an amount of heat flowing from the heating resistor to an insulating substrate side (for example, see JP 2007-83532 A).

As a method of forming the hollow portion, there is employed a method of subjecting a silicon substrate to etching or laser processing, and forming a concave portion (having a depth of 1 μm or more and 100 μm or less) to bond thin plate glass (having a thickness of 10 to 100 μm) serving as a heat accumulating layer thereon through anodic bonding performed at a temperature of 700° C. or less. In this case, it is difficult to manufacture or handle the thin plate glass having a thickness of 100 μm or less, and thus thin plate glass having a thickness, which is relatively easily handled, is bonded to a surface of the silicon substrate, and then a surface of a side opposite to a bonded surface is chipped by etching or polishing to obtain a desired thickness size.

However, the thin plate glass anodically bonded to the silicon substrate is generally soda glass or Pyrex (registered trademark) glass containing an alkaline component, and has the following problems.

That is, in the case of using cheap soda glass, a difference in coefficient of thermal expansion between the silicon substrate and the thin plate glass is large (silicon substrate: $3.3\times10^{-6}$/° C., soda glass: $8.6\times10^{-6}$/° C.), and thus warp or distortion occurs in the heating resistor element after the bonding step or during use as the thermal head, which changes contact with thermal paper to deteriorate printing quality.

In contrast, because Pyrex (registered trademark) glass has substantially the same coefficient of thermal expansion ($3.2\times10^{-6}$/° C.) as that of the silicon substrate, the above-mentioned inconvenience hardly occurs, but there are problems in that the material is costly and that processibility thereof is poor. That is, an etching rate of Pyrex (registered trademark) glass is about a tenth of that of the soda glass, and hence it is difficult to process Pyrex (registered trademark) glass to obtain a desired thickness size through etching, polishing, or the like.

SUMMARY OF THE INVENTION

The present invention has been made in view of the circumstances described above, and therefore an object thereof is to provide a heating resistor element capable of suppressing deformation caused by the difference in coefficient of thermal expansion to improve the printing quality, a manufacturing method for the same, a thermal head, and a printer.

In order to achieve the above-mentioned object, the present invention provides the following means.

The present invention provides a heating resistor element, including: an insulating substrate including a glass material; a heat accumulating layer bonded to the insulating substrate through heating to temperature ranging from an annealing point to a softening point in a state of being adhered to a surface of the insulating substrate, and including the same material as the glass material of the insulating substrate; and a heating resistor provided on the heat accumulating layer, in which, on at least one of bonded surfaces between the insulating substrate and the heat accumulating layer, at least one of the insulating substrate and the heat accumulating layer is provided with a concave portion in a region opposed to the heating resistor to form a hollow portion.

In accordance with the present invention, the insulating substrate and the heat accumulating layer, in which the concave portion is formed on the at least one of the bonded surfaces thereof, are bonded to each other, and the hollow portion formed between the insulating substrate and the heat accumulating layer is formed in the region opposed to the heating resistor. Accordingly, a transmission of the heat generated by the heating resistor to the insulating substrate side is controlled by the hollow portion, and hence the heat can be used more efficiently.

In this case, because the insulating substrate and the heat accumulating layer are formed of the same glass material, there is no difference in coefficient of thermal expansion, and warp or distortion is not generated due to heating of the heating resistor, with the result that high printing quality can be maintained.

In the invention described above, a depth of the hollow portion may be set to 1 μm or more and 100 μm or less.

Therefore, when a thickness of a gas contained in the hollow portion is sufficiently secured to be 1 μm or more, an excellent heat insulating effect can be obtained, and power consumption of the heating resistor element can be suppressed to be small. Further, when the depth of the hollow portion is set to 100 μm or less, a thickness of the heating resistor element can be made small.

Further, in the invention described above, the insulating substrate and the heat accumulating layer may be formed of alkali-free glass.

As a result, alkali ion is not eluted even after the use for a long period of time. Thus, the heating resistor and the electrodes located near the heat accumulating layer and the insulating substrate, or a driver IC provided in the vicinity thereof can be prevented from being adversely effected by the alkali ion.

Further, the alkali-free glass is cheaper than Pyrex (registered trademark) glass, and processibility thereof is excellent, whereby the heating resistor element can be manufactured at low cost.

Further, in the invention described above, the hollow portion may be completely sealed from an outside and an inside thereof may be filled with a gas.

As a result, a pressing force applied to the heating resistor can be supported by a pressure of the gas filled in the hollow portion, and thus the heating resistor element having a high pressure resistance can be provided.

Further, in the invention described above, the gas may be an inert gas.

As a result, degradation such as oxidation of the heating resistor can be prevented, and the reliability and durability thereof can be improved.

Further, in the invention described above, the hollow portion may be completely sealed from an outside, and an inside thereof may be depressurized to an atmospheric pressure or less.

As a result, a change in internal pressure of the hollow portion can be suppressed even when the temperature is changed due to an operation of the heating resistor.

Further, the present invention provides a thermal head including any one of the heating resistor elements described above.

In accordance with the present invention, heating efficiency can be improved, and manufacturing cost can be reduced. In addition, warp or distortion is unlikely to occur in the thermal head after being used for a long period of time, and the heating resistor, the electrode, a driver IC arranged in the vicinity thereof, or the like is maintained in a sound state, whereby high printing performance can be maintained.

Further, the present invention provides a printer including the above-mentioned thermal head.

In accordance with the present invention, printing can be performed clearly with low power consumption at low cost for a long period of time without interruption.

Further, the present invention provides a manufacturing method for a heating resistor element, including: a concave portion forming step of forming a concave portion on at least one of bonded surfaces between an insulating substrate and a heat accumulating layer including the same glass material; a bonding step of bonding the insulating substrate and the heat accumulating layer to each other through heating to temperature ranging from an annealing point to a softening point of the same glass material forming the insulating substrate and the heat accumulating layer in a state of the bonded surfaces between the insulating substrate and the heat accumulating layer being adhered to each other; and a resistor forming step of forming a heating resistor at a position on the heat accumulating layer, the position being opposed to the concave portion.

In accordance with the present invention, in the bonding step, the insulating substrate and the heat accumulating layer are bonded to each other through heating to temperature ranging from an annealing point to a softening point of the material forming the insulating substrate and the heat accumulating layer in a state of the insulating substrate and the heat accumulating layer being adhered to each other, and hence the same glass materials can be bonded to each other easily and reliably without using an adhesive. As a result, there can be manufactured a heating resistor element capable of efficiently using heat generated by the heating resistor to reduce power consumption, and preventing an occurrence of warp or distortion caused by the heating to maintain high printing performance.

In accordance with the present invention, there is achieved an effect that deformation caused by the difference in coefficient of thermal expansion is suppressed to improve the printing quality.

BRIEF DESCRIPTION OF THE DRAWINGS

In the accompanying drawings:

FIG. 4A is a front view, FIG. 4B is a vertical cross sectional view taken along a line a-a of FIG. 4A, and FIG. 4C is a vertical cross sectional view taken along a line b-b of FIG. 4A, for explaining a shape of a hollow portion of the heating resistor element of FIG. 3;

DETAILED DESCRIPTION OF THE PREFERRED EMBODIMENT

Hereinafter, a heating resistor element 1, a manufacturing method for the same, a thermal head 2, and a thermal printer (printer) 3 according to an embodiment of the present invention are described with reference to FIGS. 1 to 7.

Figure 1:
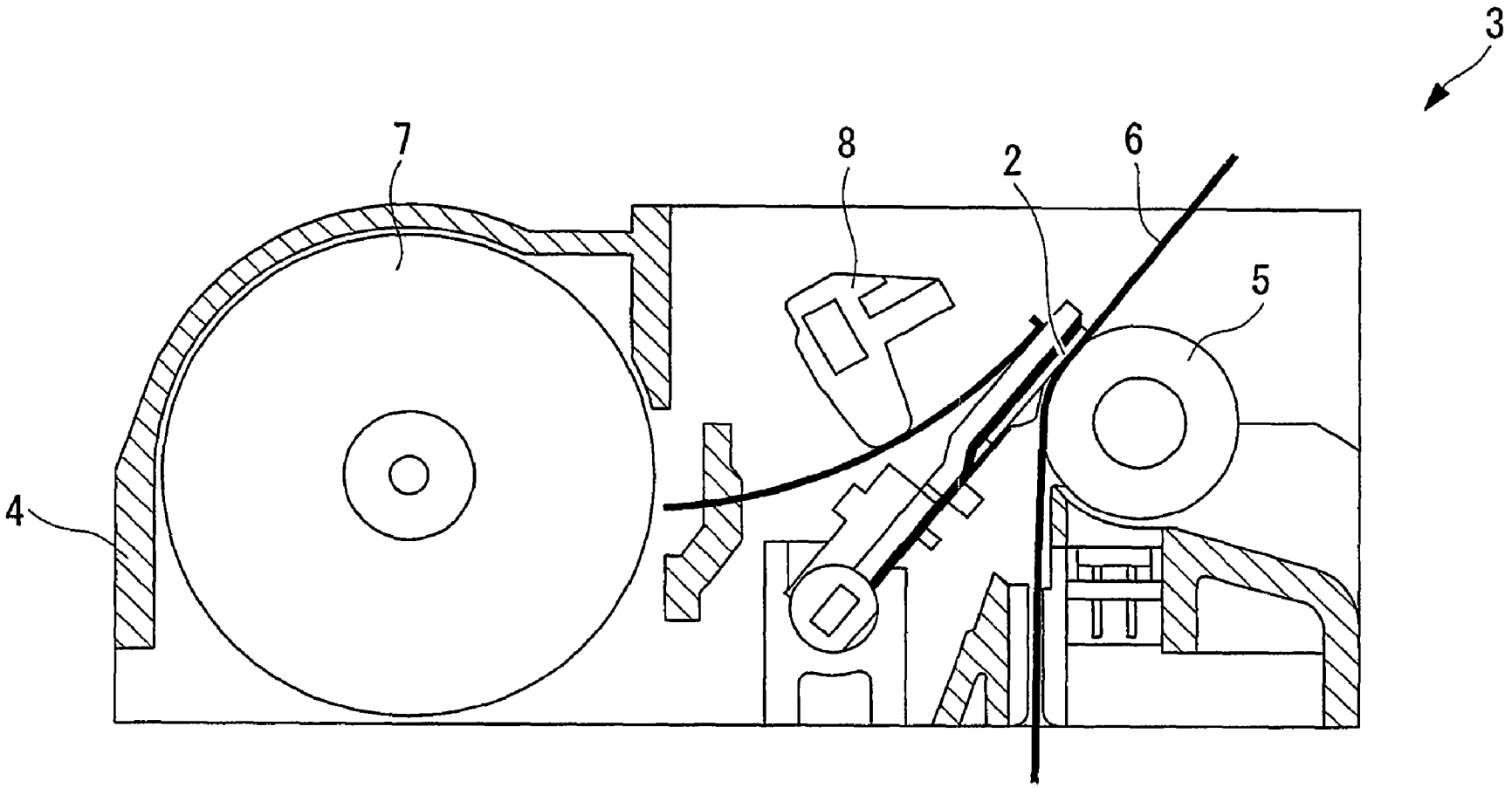
FIG. 1 is a vertical cross sectional view showing structure of a thermal printer according to an embodiment of the present invention.

The heating resistor element 1 according to this embodiment is used in the thermal head 2 of the thermal printer 3 shown in FIG. 1.

The thermal printer 3 includes a body frame 4, a platen roller 5 which is horizontally arranged, the thermal head 2 which is arranged to be opposed to an outer periphery of the platen roller 5, a sheet feeding mechanism 7 feeding thermal paper 6 between the platen roller 5 and the thermal head 2, and a pressurizing mechanism 8 pressing the thermal head 2 against the thermal paper 6 with a predetermined pressing force.

Figure 2:
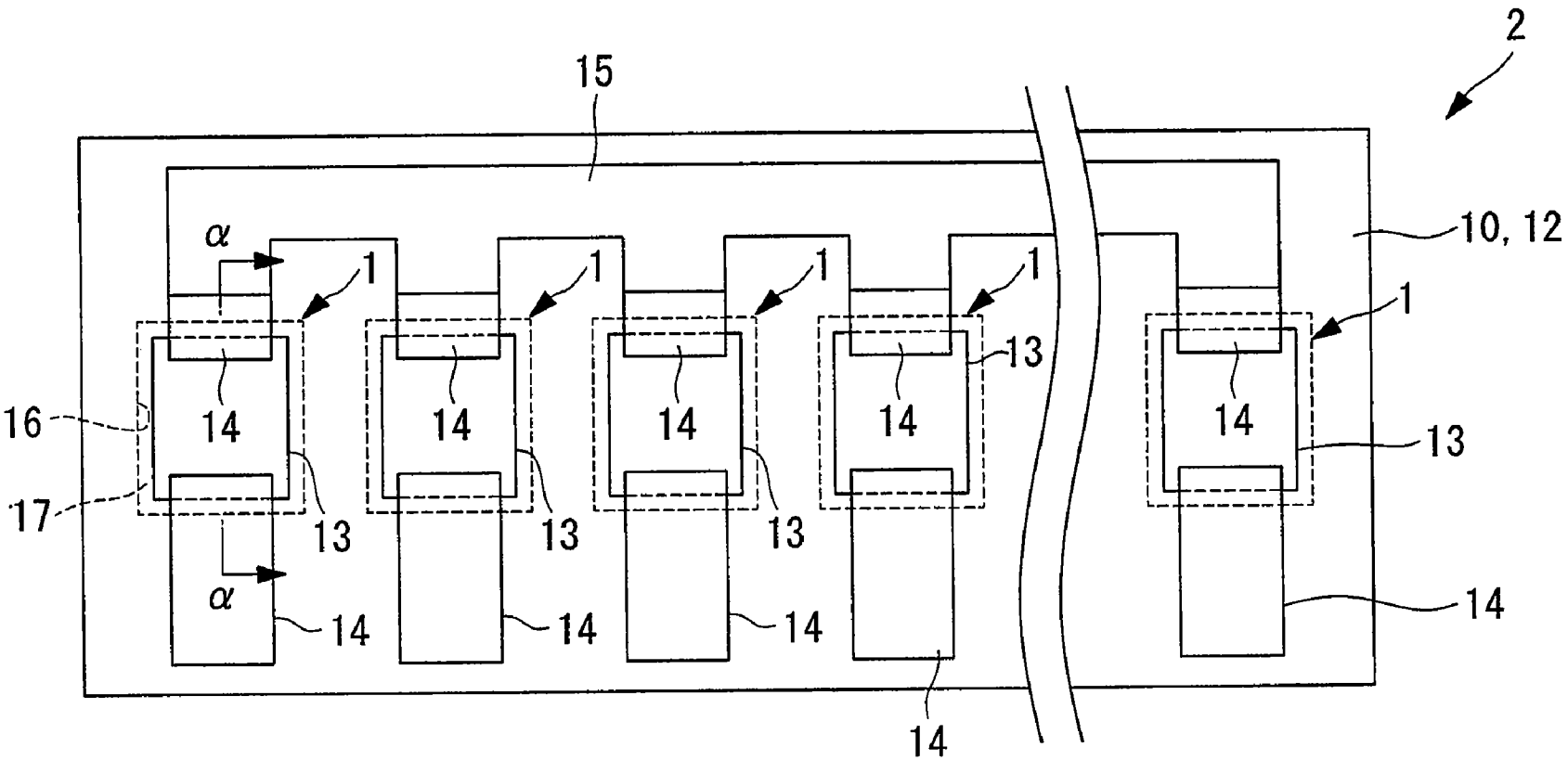
FIG. 2 is a front view showing a thermal head according to the embodiment of the present invention, which is provided in the thermal printer of FIG. 1.
Figure 3:
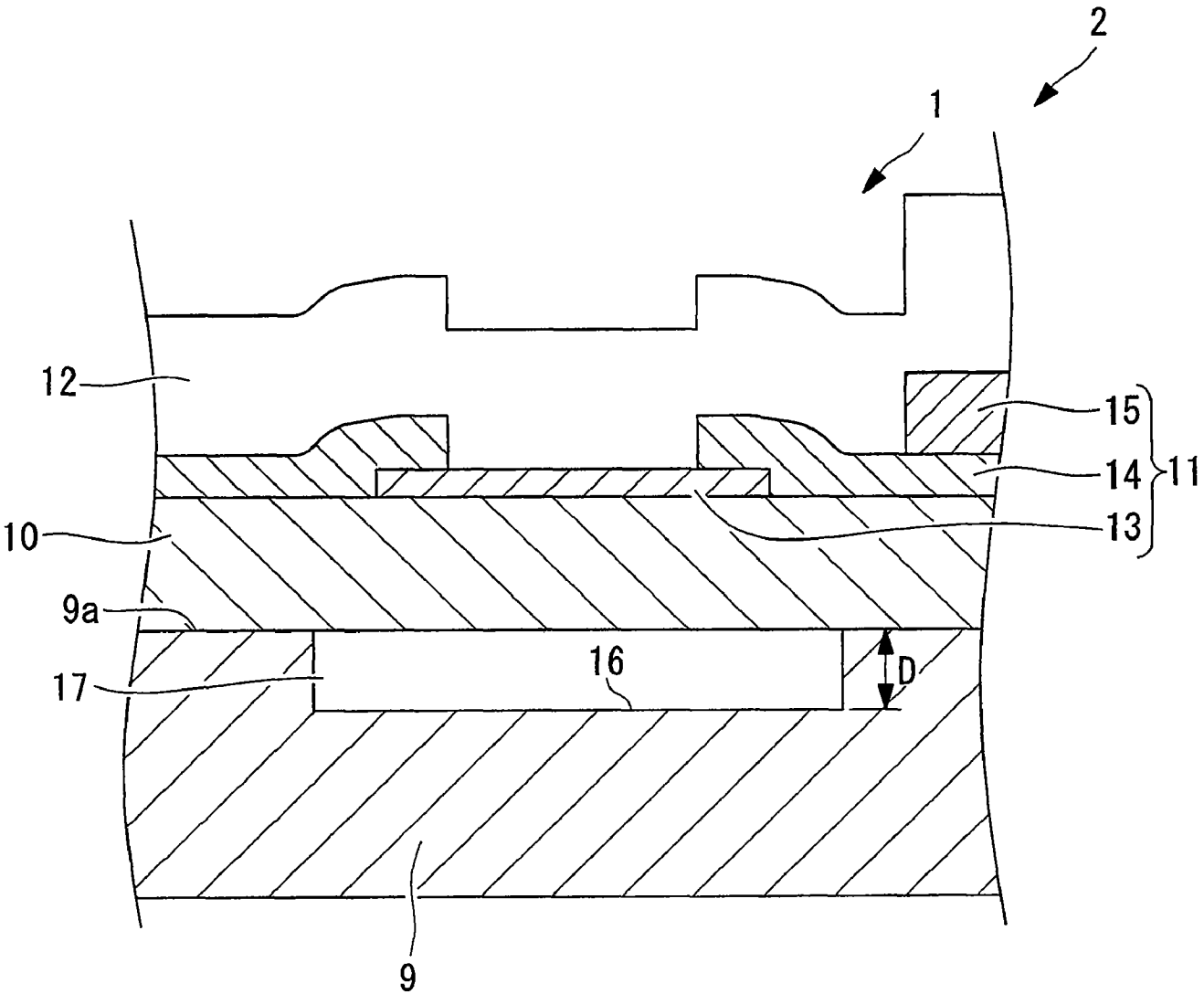
FIG. 3 is a vertical cross sectional view showing a heating resistor element according to the embodiment of the present invention, which is provided in the thermal head of FIG. 2, taken along a line α-αof FIG. 2.

The thermal head 2 is formed in a flat plate-like shape as shown in a front view of FIG. 2, and includes a plurality of heating resistor elements 1 at intervals. As shown in a vertical cross sectional view of FIG. 3, each of the plurality of heating resistor elements 1 includes an insulating substrate 9, a heat accumulating layer 10, a heating resistor 11, and a protective film layer 12 in a laminated state.

The insulating substrate 9 is bonded to a radiator plate (not shown).

The insulating substrate 9 and the heat accumulating layer 10 are each formed of alkali-free glass (Corning 1737), and are bonded to each other in a state of adhering to each other through heating to temperature ranging from an annealing point (720° C.) to a softening point (975° C.) of the material forming the insulating substrate 9 and the heat accumulating layer 10.

The heat accumulating layer 10 is formed to have a thickness of 2 μm or more and 100 μm or less.

The heating resistor 11 includes a heating resistor layer 13 formed in a predetermined pattern on the heat accumulating layer 10, individual electrodes 14 provided in contact with the heating resistor layer 13 on the heat accumulating layer 10, and a common electrode 15.

On at least any one of bonded surfaces of the insulating substrate 9 and the heat accumulating layer 10 (bonded surface 9*a* of insulating substrate 9 in this embodiment), a concave portion 16 is formed in a region opposed to each heating resistor 11. When the insulating substrate 9 and the heat accumulating layer 10 are bonded to each other in an adhering state, an aperture of the concave portion 16 is blocked by a flat surface of the heat accumulating layer 10, with the result that a sealed hollow portion 17 is provided at a position opposed to the heating resistor 11, which is located between the insulating substrate 9 and the heat accumulating layer 10.

In this case, the concave portion 16 may have an appropriate shape, and a size thereof may be larger or smaller compared with the heating resistor 11 as long as the size is close to a size of the heating resistor 11.

When the concave portion 16 is viewed from the heating resistor 11 side in a laminating direction, in a case where the concave portion 16 is made larger than a heating effective area of the heating resistor 11, heat insulating performance between the heating resistor 11 and the insulating substrate 9 can be improved. On the other hand, in a case where the size of the concave portion 16 is made smaller than the heating effective area of the heating resistor 11, a mechanical strength of the heating resistor element 1 with respect to the pressing force in the laminating direction can be improved.

In this embodiment, the concave portion 16 is provided on the insulating substrate 9 side, and is formed in a quadrangle, which substantially has a similar shape as and is slightly larger than the heating resistor 11 when the concave portion 16 is viewed from the heating resistor 11 side in the laminating direction. Further, a depth D of the concave portion 16 is set to 1 μm or more and 100 μm or less. In other words, in the heating resistor element 1, a thickness of a gas layer within the hollow portion 17 is sufficiently ensured to be 1 μm or more, and a heat insulating effect obtained by the gas layer is large. Besides, when the depth D of the concave portion 16 is set to be 100 μm or less, a thickness size of the heating resistor element 1 can be suppressed to be sufficiently small.

Further, in this embodiment, as shown in FIGS. 4A to 4C, corners R1, R2, and R3 of the concave portion 16 each are formed in a shape having a curvature radius of 10 μm or more. Further, an inner surface of the concave portion 16 is formed to have surface roughness Ra of 0.2 μm or more. FIG. 4A is a front view of the concave portion 16, which is viewed from the aperture side, and FIGS. 4B and 4C are vertical cross sectional views taken along a line a-a of FIG. 4A and a line b-b of FIG. 4A, respectively.

Note that there is the following relationship between an aperture size W or L of the concave portion 16 and a curvature radius R1, R2, or R3 of each corner. That is, 10 μm≦R1≦½L, 10 μm≦R2≦½W, 10 μm≦R3≦½L (in a case of L≦W), or 10 μm≦R3≦½W (in a case of W≦L).

Next, descriptions are made of the heating resistor element 1 and a manufacturing method for the thermal head 2 according to this embodiment.

First, the concave portion 16 having a predetermined depth is formed in a region of a surface of the insulating substrate 9, in which the heating resistor 11 is formed (concave portion forming step).

Figure 5A:
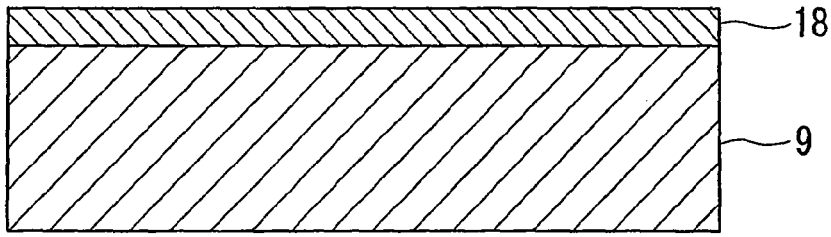
FIGS. 5A to 5F are views for explaining a manufacturing method for the heating resistor element of FIG. 3.
Figure 5B:
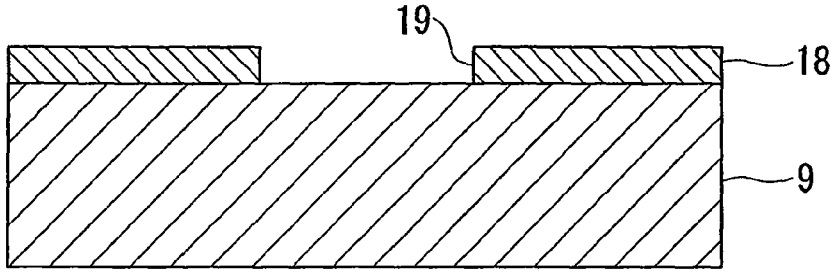
Figure 5C:
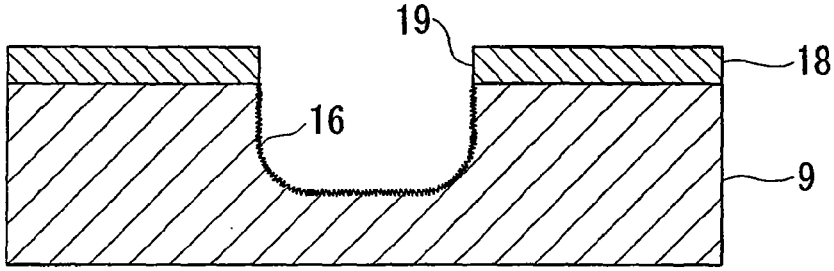

As shown in FIGS. 5A to 5F, the concave portion 16 is formed as follows. A photoresist material 18 capable of absorbing an impact of a urethane-based material is applied onto a surface of an alkali-free glass substrate forming the insulating substrate 9 (FIG. 5A), and the photoresist material 18 is exposed using a photomask (not shown) having a predetermined pattern, a part other than a region in which the hollow portion 17 is to be formed is solidified, and a part which is not solidified is removed to form a window portion 19 (FIG. 5B). In this state, a part of the insulating substrate 9 corresponding to the window portion 19 is chipped through sandblast processing (FIG. 5C). As a result, the concave portion 16, which has a curvature radius of 10 μm or more at corners and includes an inner surface of surface roughness Ra of 0.2 μm or more, can be easily formed.

The curvature radius of the corner and the surface roughness can be adjusted to a desired value through appropriate adjustments of a shape of the mask, a diameter of a sand particle, a blast pressure, an amount of the sand particles and a spraying angle. In a case where the surface roughness Ra is less than 0.2 μm, the diameter of the sand particle needs to be extremely small, and a processing amount (removed amount) per unit time is considerably reduced, which is not suitable for mass production.

Figure 5D:
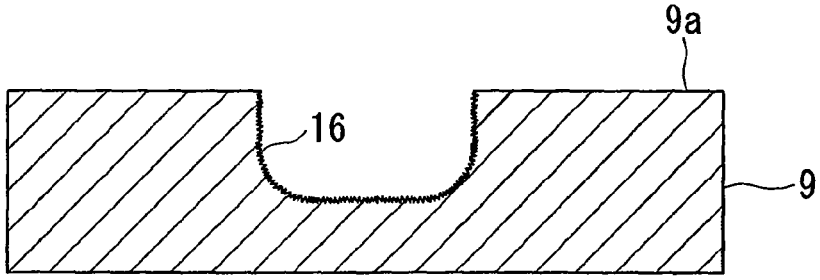

In this state, the photoresist material 18 is removed from the surface of the insulating substrate 9 (FIG. 5D). Note that the concave portion 16 may be formed by high temperature forming using a die in place of the sandblast processing.

Figure 5E:
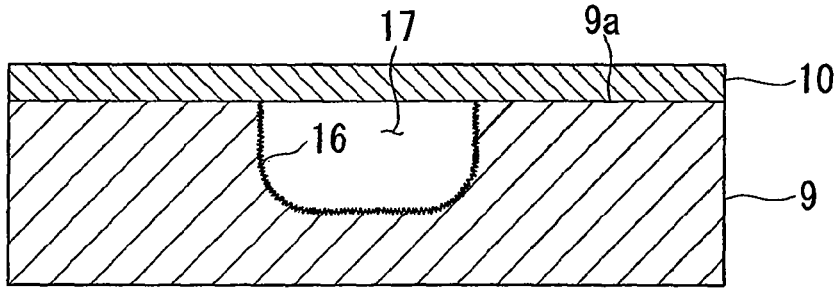

Then, the alkali-free glass substrate serving as the heat accumulating layer 10 is prepared, and is adhered to the bonded surface 9*a* of the insulating substrate 9 in which the concave portion 16 is formed to block the concave portion 16 (FIG. 5E). In this state, the insulating substrate 9 and the heat accumulating layer 10 are heated to temperature ranging from an annealing point (720° C.) to a softening point (975° C.) of the alkali-free glass, to thereby bond the insulating substrate 9 and the heat accumulating layer 10 to each other (bonding step).

Figure 5F:
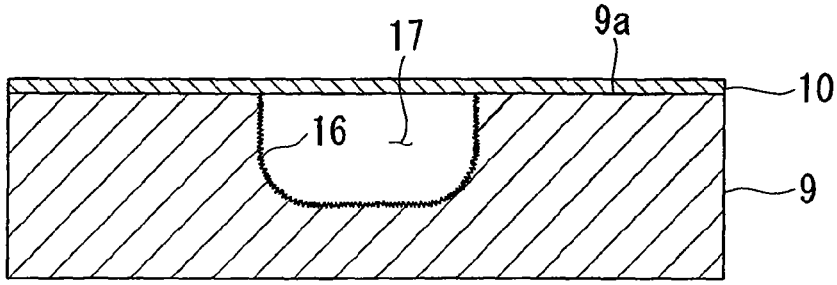

After that, a surface opposite to the bonded surface of the heat accumulating layer 10 is removed through etching, polishing, or the like to process the heat accumulating layer 10 to have a desired thickness size (2 μm to 100 μm) (FIG. 5F).

Then, the heating resistor layer 13, the individual electrodes 14, the common electrode 15, and the protective film layer 12 are sequentially formed (resistor forming step). Note that the heating resistor layer 13, the individual electrodes 14, the common electrode 15, and the protective film layer 12 may be formed in an appropriate order.

Those heating resistor layer 13, individual electrodes 14, common electrode 15, and protective film layer 12 can be formed using a manufacturing method for those components of a conventional heating resistor element.

Specifically, a thin film made of a material of the heating resistor layer 13, such as Ta-based material or a silicide-based material, is formed on the heat accumulating layer 10 using a thin film forming method such as sputtering, chemical vapor deposition (CVD), or vapor deposition, and the thin film made of the material of the heating resistor layer 13 is molded using a lift-off method or an etching method, whereby the heating resistor layer 13 in a desired shape is formed.

Similarly, a film made of a wiring material such as Al, Al—Si, Au, Ag, Cu, or Pg is formed on the heat accumulating layer 10 by sputtering, vapor deposition, or the like, and then the formed film is molded using the lift-off method or the etching method. Alternatively, the wiring material is subjected to screen printing, and then is subjected to baking or the like. Accordingly, the individual electrodes 14 and the common electrode 15 having a desired shape are formed.

In this embodiment, two separate individual electrodes 14 are provided for one heating resistor layer 13, and the common electrode 15 is provided to cover one of the two separate individual electrodes 14 for reducing a wiring resistance value of the common electrode 15.

Then, after the formation of the heating resistor layer 13, the individual electrodes 14, and the common electrode 15, a film made of a material of the protective film layer 12, such as $SiO_2$, $Ta_2O_5$, SiAlON, $Si_3N_4$, or diamond-like carbon is formed on the heat accumulating layer 10 by sputtering, ion plating, CVD, or the like to form the protective film layer 12. As a result, the thermal head 2 including the plurality of heating resistor elements 1 according to this embodiment is manufactured.

In accordance with the thus formed heating resistor element 1 and the thermal head 2 according to this embodiment, the hollow portion 17 is formed in the region between the insulating substrate 9 and the heat accumulating layer 10, which is opposed to the heating resistor 11, and the gas layer formed within the hollow portion 17 functions as the heat insulating layer controlling a flow of heat from the heat accumulating layer 10 to the insulating substrate 9. In this embodiment, the depth D of the concave portion 16 is 1 μm or more, and thus a sufficiently thick gas layer is formed, and large heat insulating effects are achieved.

Further, the thickness of the heat accumulating layer 10 is set to 100 μm or less, and thus a heat capacity of the heat accumulating layer 10 itself is small, and the heat generated by the heating resistor 11 is prevented from being taken by the heat accumulating layer 10.

In this manner, in accordance with the heating resistor element 1 and the thermal head 2 according to this embodiment, the heat generated by the heating resistor 11 can be effectively used without letting out the heat generated by the heating resistor 11 to the heat accumulating layer 10 side.

Therefore, heating efficiency of the heating resistor 11 can be improved to reduce power consumption.

Besides, the heat generated by the heating resistor 11 is difficult to be transmitted to the insulating substrate 9, which has an advantage in that a temperature of the entire thermal head 2 is difficult to increase even after the thermal head 2 is repeatedly used.

Further, in the heating resistor element 1 according to this embodiment, the heat accumulating layer 10 and the insulating substrate 9 are formed of the same glass material, and hence there is no difference in coefficient of thermal expansion, with the result that warp or distortion is not caused by the heat generated by the heating resistor 11.

Moreover, in the heating resistor element 1 according to this embodiment, the heat accumulating layer 10 and the insulating substrate 9 are formed of the alkali-free glass, and thus alkali ion is not eluted even after the heating resistor element 1 is used for a long period of time. Thus, the heating resistor 11, the individual electrodes 14, and the common electrode 15 which are located near the heat accumulating layer 10 and the insulating substrate 9, or a driver IC provided in the vicinity thereof can be prevented from being adversely effected by the alkali ion.

The alkali-free glass is cheaper than Pyrex (registered trademark) glass, and its processibility is excellent, whereby the heating resistor element 1 can be manufactured at low cost.

Further, a coefficient of thermal conductivity of glass is 0.9 W/mK and a coefficient of thermal conductivity of air is 0.02 W/mK, whereas a coefficient of thermal conductivity of silicon is 168 W/mK. The alkali-free glass substrate is employed in place of a conventional silicon substrate, and thus the coefficient of thermal conductivity can be sufficiently reduced, and heat is prevented from being dissipated from the heat accumulating layer 10 through the insulating substrate 9. Accordingly, the heat efficiency can be further increased.

Further, in the heating resistor element 1 according to this embodiment, surface roughness Ra of the inner surface of the concave portion 16, which forms the hollow portion 17, is set to be 0.2 μm or more, and thus a surface area thereof is increased more compared with the inner surface of a concave portion which is smoothly formed by etching or the like. Thus, there can be increased opportunities for molecules of the gas filled in the hollow portion 17 to collide against the insulating substrate 9.

Figure 6A:
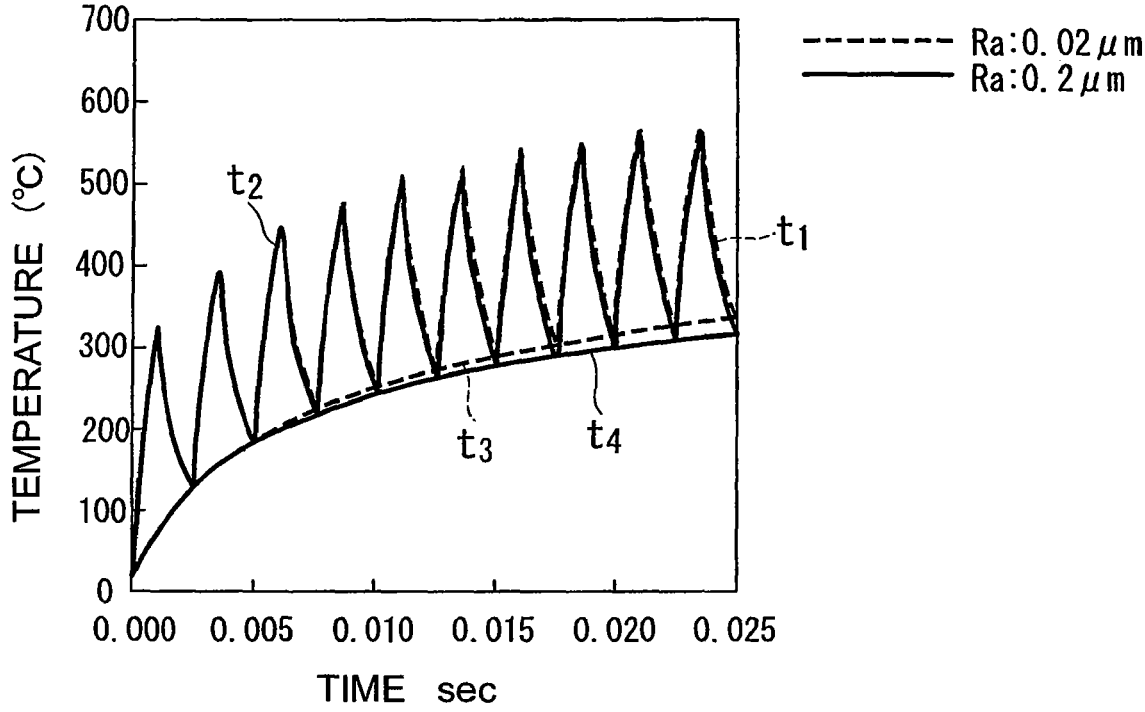
FIGS. 6A and 6B are graphs showing thermal responsibility for each surface roughness of an inner surface of the hollow portion in the heating resistor element of FIG. 3.
Figure 6B:
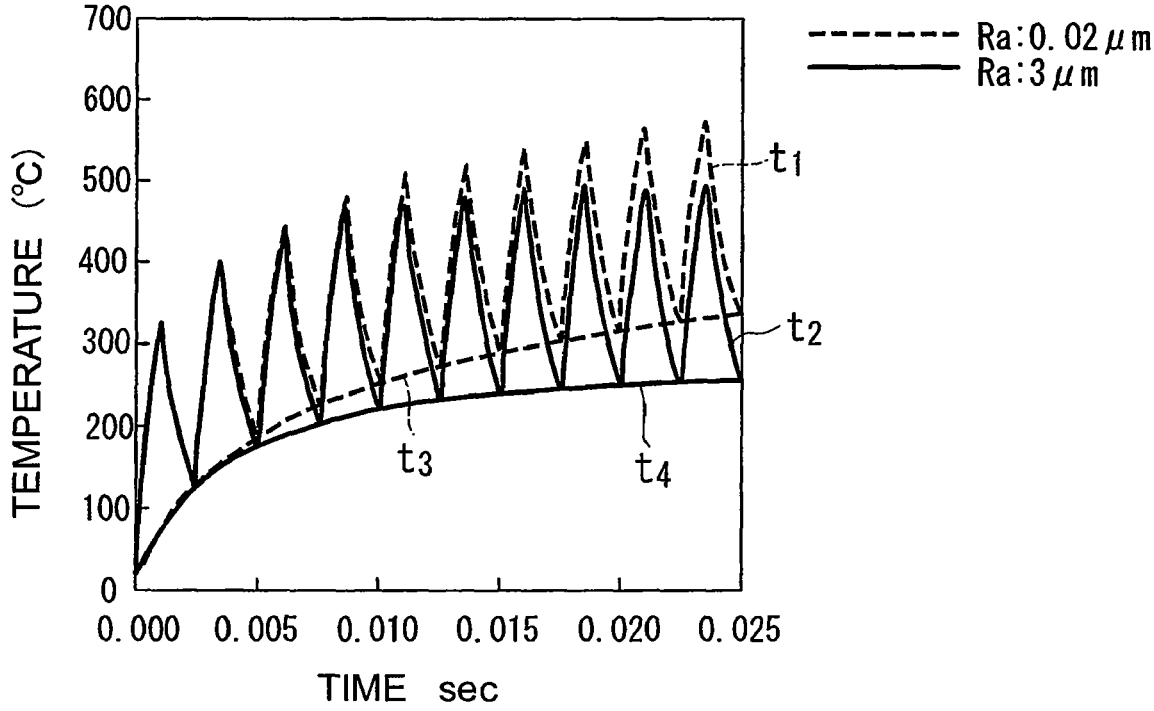

For example, FIGS. 6A and 6B show thermal responsibility of the heating resistor element 1 for each surface roughness of the concave portion 16. In FIGS. 6A and 6B, graphs t1 and t2 show a temperature change of the thermal head 2 when a voltage is applied to the thermal head 2 for a predetermined period of time and then is stopped for a predetermined period of time. Graphs t3 and t4 are imaginary curves forming points indicating temperatures of the thermal head 2 before application of a voltage, which are added for easily explaining the thermal head 2 according to the present invention.

FIG. 6A is a graph showing the thermal responsibility in the case of the smallest surface roughness (Ra: 0.2 μm) according to this embodiment in contrast with a surface roughness (Ra: 0.02 μm) according to the prior art, and FIG. 6B is a graph showing the thermal responsibility in the case of the largest surface roughness (Ra: 3 μm) according to this embodiment in contrast with the surface roughness (Ra: 0.02 μm) according to the prior art. Those graphs show that, in accordance with this embodiment, a rise in temperature due to the use for a long period of time can be suppressed to be smaller compared with the prior art.

Figure 7:
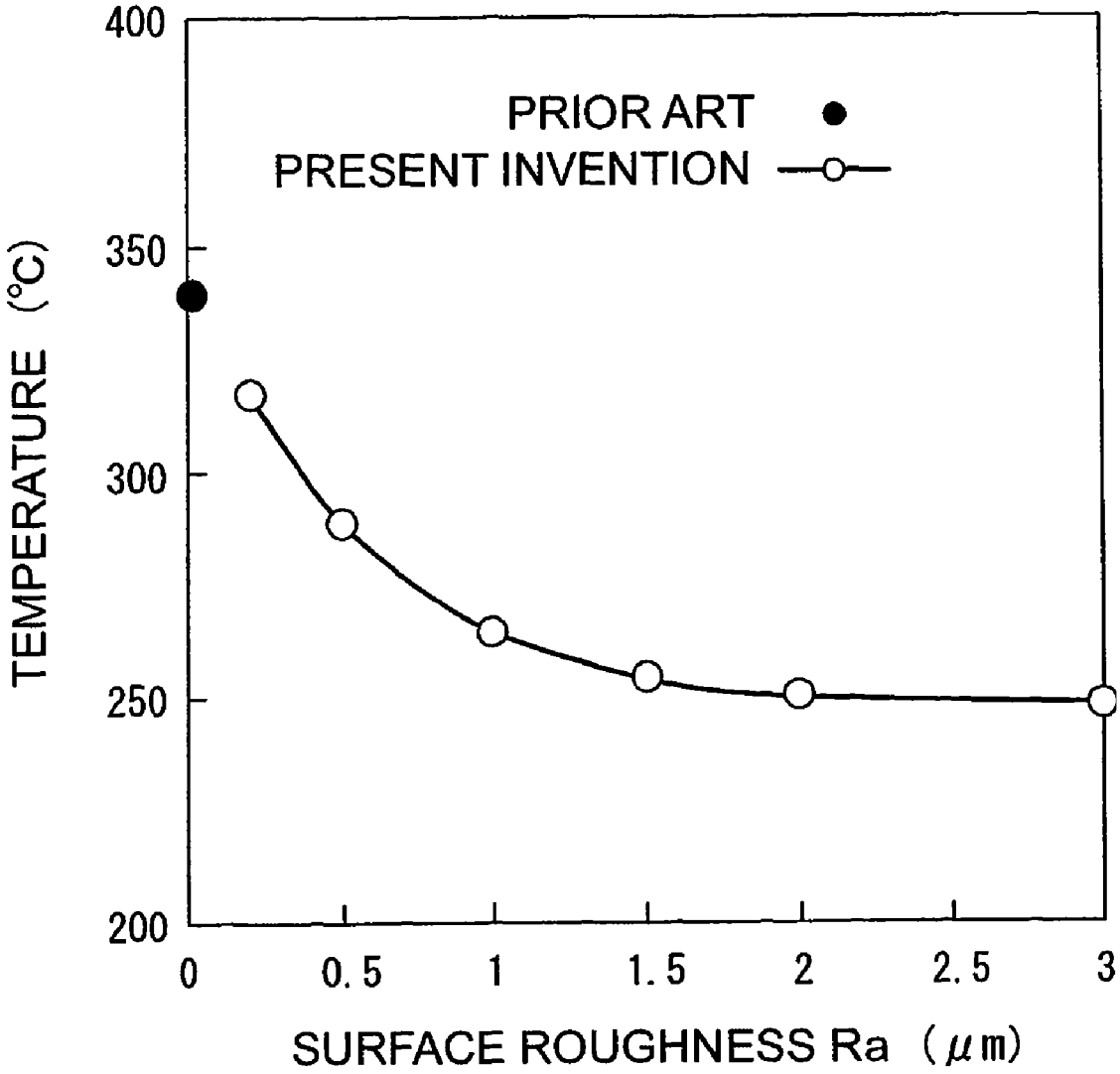
FIG. 7 is a graph showing a relationship between a temperature of the heating resistor element and the surface roughness of the inner surface of the hollow portion after repeated heating.

FIG. 7 shows a relationship between the temperature of the heating resistor element 1 and the surface roughness of the inner surface of the hollow portion 17 after the repeated heating of ten pulses is performed (after 0.025 seconds) as shown in FIGS. 6A and 6B.

Those graphs show that, in accordance with the heating resistor element 1 according to this embodiment, the heat transmitted to the gas layer can be promptly transmitted to the insulating substrate 9 to be dissipated.

Further, in the heating resistor element 1 according to this embodiment, the corners R1 to R3 of the concave portion 16 forming the hollow portion 17 are formed in a rounded shape to have the curvature radius of 10 μm or more, and thus stress concentration caused in the corners R1 to R3 is suppressed, resulting in an improvement of a mechanical strength. Moreover, by virtue of the large mechanical strength, the heating resistor element 1 having a sufficient mechanical strength can be provided even when the thickness of the heat accumulating layer 10 is set to 2 to 100 μm. When the heat accumulating layer 10 is made thinner, heating efficiency can be further improved.

Accordingly, in accordance with the thermal printer 3 including the thermal head 2 according to this embodiment, the heat generated by the heating resistor 11 is difficult to be accumulated in the heat accumulating layer 10 or the hollow portion 17 even after the use for a long period of time, with the result that the heat can be efficiently used and the hollow portion 17 can be prevented from becoming a heat source. As a result, a decrease in printing quality caused by a phenomenon such as tailing can be prevented. Besides, warp or distortion caused by the difference in coefficient of thermal expansion is not generated in the thermal head 2, and thus the contact between the thermal head 2 and the thermal paper 6 is not changed, which prevents a decrease in printing quality.

Further, the mechanical strength of the thermal head 2 is large, and thus the thermal head 2 can be maintained in a sound state even when the pressing force repeatedly acts for a long period of time.

Accordingly, the heating resistor element 1, the thermal head 2, and the thermal printer 3 each having secured long-term reliability and high efficiency can be provided.

Further, in accordance with a manufacturing method for the heating resistor element 1 according to this embodiment, the heat accumulating layer 10 and the insulating substrate 9 made of the same alkali-free glass are bonded to each other through heating to temperature ranging from the annealing point to the softening point of the alkali-free glass, and thus an adhesive layer is not required, and a material for the adhesive layer and the formation step for the adhesive layer are unnecessary. Therefore, the heating resistor element 1 can be easily manufactured in a short period of time at low cost.

Note that, in the heating resistor element 1 according to this embodiment, the insulating substrate 9 and the heat accumulating layer 10 are formed of the same alkali-free glass, but not limited thereto, and may be formed of the same soda glass material or the same Pyrex (registered trademark) glass material. The insulating substrate 9 and the heat accumulating layer 10 can be also easily bonded to each other through heating to temperature between an annealing point (540° C.) and a softening point (730° C.) in the case of the soda glass material, and to temperature between an annealing point (565° C.) and a softening point (820° C.) in the case of the Pyrex (registered trademark) glass material.

Figure 9A:
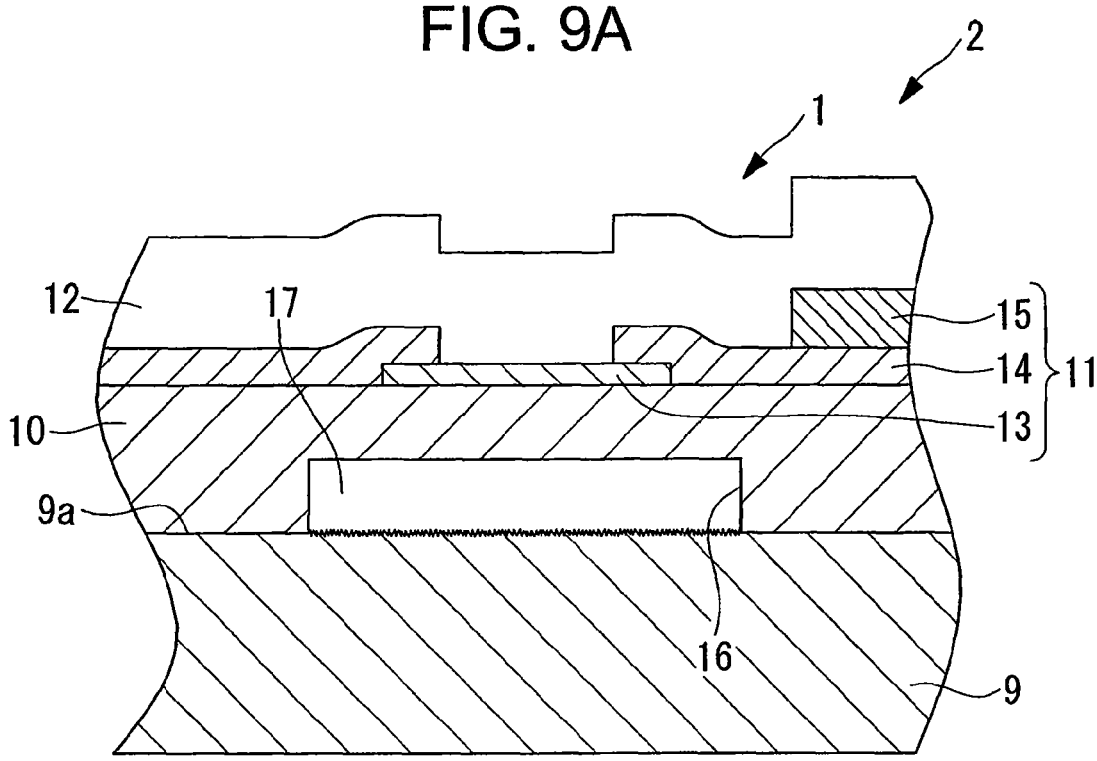
FIGS. 9A and 9B are vertical cross sectional views each showing a modification of the heating resistor element of FIG. 3.
Figure 9B:
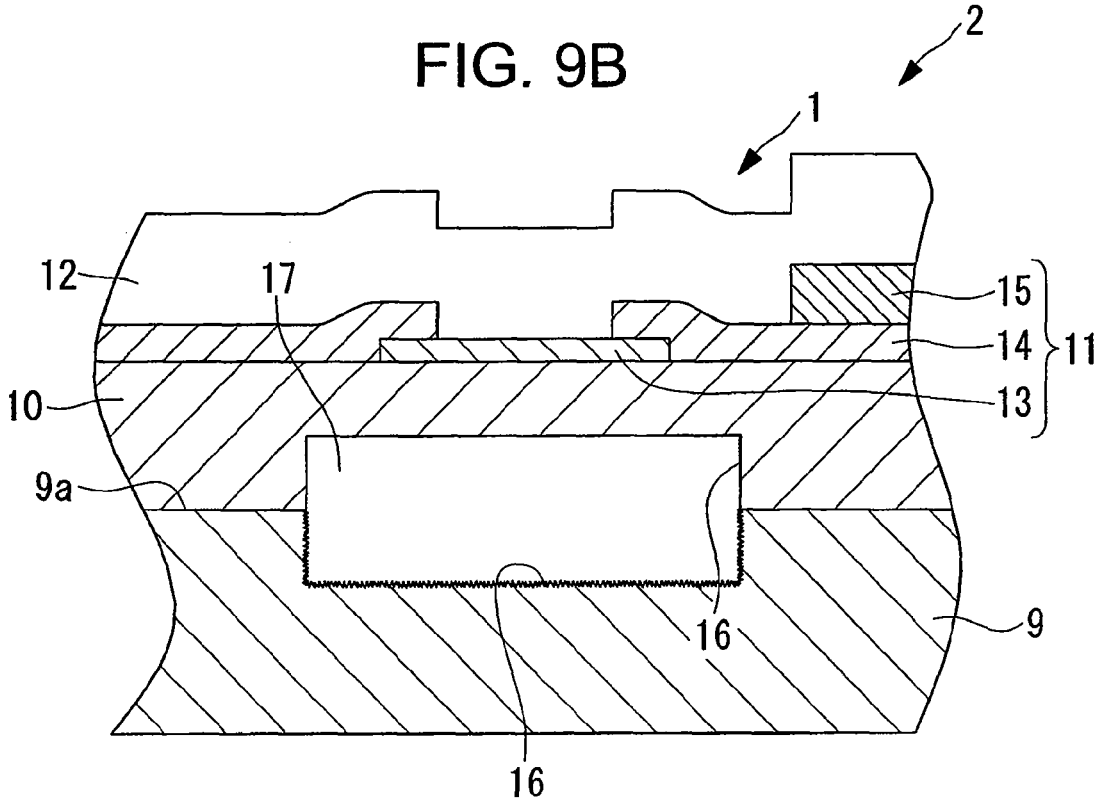

Further, in this embodiment, the concave portion 16 provided in the insulating substrate 9 is blocked by the flat heat accumulating layer 10, thereby providing the hollow portion 17 having the inside filled with air. However, in place of this, as shown in FIG. 9A, the concave portion 16 may be provided in the heat accumulating layer 10 and be blocked by the flat insulating substrate 9 to form the hollow portion 17. Alternatively, as shown in FIG. 9B, the concave portions 16 may be provided in both the heat accumulating layer 10 and the insulating substrate 9 to be bonded to each other to form the hollow portion 17.

In any case, preferably, the inner surface of the hollow portion 17 provided in the heat accumulating layer 10 is formed smoothly, and the inner surface of the hollow portion 17 provided in the insulating substrate 9 is formed to have the surface roughness Ra of 0.2 μm or more.

As a result, the heat transmission from the heat accumulating layer 10 to the gas layer of the hollow portion 17 is suppressed, and the heat transmission from the gas layer to the insulating substrate 9 is promoted, whereby inconvenience of the hollow portion 17 becoming the heat source can be prevented.

In the case of providing the concave portion 16 in the heat accumulating layer 10, a thickness of the smallest part of the heat accumulating layer 10 is preferably 2 μm or more and 100 μm or less.

Further, the concave portions 16 may be provided on the bonded surfaces of the insulating substrate 9 and the heat accumulating layer 10, respectively, to be combined with each other and thereby form the hollow portion 17.

Further, the hollow portion 17 may be filled with an inert gas such as $N_2$, He, or Ar in place of air. As a result, even when the gas penetrates the heat accumulating layer 10 to reach the heating resistor 11, the heating resistor 11 can be prevented from undergoing oxidation or characteristic degradation, and the reliability and durability thereof can be improved.

Further, the hollow portion 17 may be completely sealed and the pressure within the hollow portion 17 may be reduced to an atmospheric pressure or less. As a result, heat insulating effect obtained by the hollow portion 17 can be improved.

Figure 8:
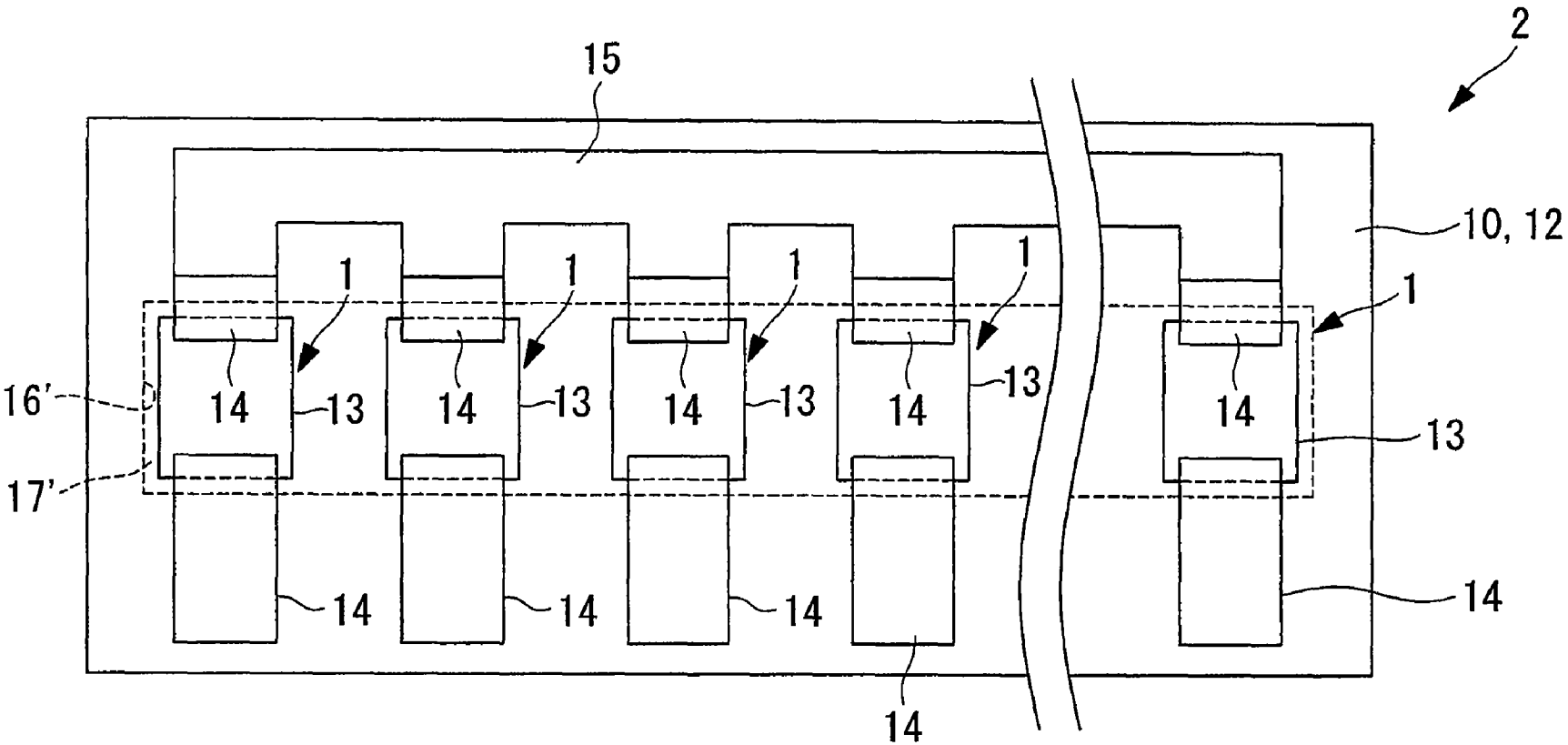
FIG. 8 is a front view showing a modification of the thermal head of FIG. 2.

Further, in this embodiment, the hollow portion 17 is individually provided to be opposed to the each heating resistor 11. However, as shown in FIG. 8, in place of the concave portion 16 and the hollow portion 17 described above, there may be provided a common concave portion 16' and a common hollow portion 17' which are provided to be opposed to the plurality of heating resistors 11.

What is claimed is:

1. A heating resistor element, comprising:

an insulating substrate including an alkali-free glass material;

a heat accumulating layer including the alkali-free glass, the heat accumulating layer thermally bonded to the insulating substrate; and a heating resistor provided on the heat accumulating layer, wherein, a concave is formed in at least one of bonded surfaces of the insulating substrate and the heat accumulating layer in alignment with the heating resistor so as to form a hollow portion between the bonded insulating substrate and heat accumulating layer.

2. The heating resistor element according to claim 1, wherein a depth of the hollow portion is 1 μm or more and 100 μm or less.

3. The heating resistor element according to claim 1, wherein the hollow portion is completely sealed from an outside and an inside thereof is filled with a gas.

4. The heating resistor element according to claim 3, wherein the gas comprises an inert gas.

5. The heating resistor element according to claim 1, wherein the hollow portion is completely sealed from an outside, and an inside thereof is depressurized to an atmospheric pressure or less.

6. A thermal head, comprising the heating resistor element according to claim 1.

7. A printer, comprising the thermal head according to claim 6.

8. The heating resistor element according to claim 1, wherein the hollow portion has corners at least one of which has a curvature radius of 10 μm or more.

9. The heating resistor element according to claim 1, wherein the hollow portion has an inner surface whose surface roughness Ra is 0.2 μm or more.

10. A manufacturing method for a heating resistor element, comprising:

forming step of forming a concave portion in at least one of an insulating substrate and a heat accumulating layer which include a same glass material;

placing the insulating substrate and the heat accumulating layer together so as to have the concave portion sealed between them so as to form a hollow portion therein;

thermally bonding the insulating substrate and the heat accumulating layer together through heating the insulating substrate and the heat accumulating layer under a temperature ranging from an annealing point to a softening point of the glass material while the insulating substrate and the heat accumulating layer are placed together; and forming a heating resistor at a position on the heat accumulating layer in alignment with the hollow portion.

11. The manufacturing method according to claim 10, wherein forming a concave portion comprises forming a concave portion so that the hollow portion has corners at least one of which has a curvature radius of 10 μm or more.

12. The manufacturing method according to claim 10, wherein forming a concave portion comprises forming a concave portion so that the hollow portion has an inner surface whose surface roughness Ra is 0.2 μm or more.

* * * * *